United States Patent [19]

Neale

[11] Patent Number: 4,534,497

[45] Date of Patent: Aug. 13, 1985

[54] BLANK FOR CARTON FOR HOLDING AND DISPENSING PLASTIC FILM

[75] Inventor: Douglas L. Neale, Libertyville, Ill.

[73] Assignee: Federal Paper Board Co., Inc., Montvale, N.J.

[21] Appl. No.: 549,469

[22] Filed: Nov. 7, 1983

[51] Int. Cl.[3] ..... B65D 85/671

[52] U.S. Cl. ..... 225/25; 225/48

[58] Field of Search ..... 225/25, 26, 48–50; 229/175; 493/150, 148; 53/447; 156/289, 537

[56] References Cited

U.S. PATENT DOCUMENTS

| | | | |
|---|---|---|---|
| 3,028,060 | 4/1962 | Haley | 225/25 X |
| 3,845,894 | 11/1974 | Merlin | 225/25 |
| 3,974,947 | 8/1976 | Budny | 225/25 |
| 4,179,325 | 12/1979 | Staats et al. | 156/537 X |
| 4,241,198 | 12/1980 | Kobayashi | 156/289 X |
| 4,307,828 | 12/1981 | Sias et al. | 225/25 |
| 4,417,678 | 11/1983 | Roccaforte | 225/48 X |

*Primary Examiner*—Frank T. Yost

*Attorney, Agent, or Firm*—Charles A. Brown; Charles E. Brown

[57] ABSTRACT

This relates to a carton for dispensing plastic film wherein the carton is provided on a front wall of the bottom thereof with adhesive to hold the projecting portion of the plastic film in place after a preceding portion had been severed from the roll. In lieu of the customary adhesive spot, there is a printed, registered, continuous film coating of adhesive on the front wall. There is also a resist coating applied to the opposite face of the front wall so that when the carton is in a blank form and recently coated cartons overlie one another, the front panel of one cartor will not stick to the rear surface of the front panel of the next carton. The release or resist coating is in a pattern whereby when a reinforcing flap carried by the front panel is reversely turned and glued in place, it will stick to the rear surface of the front panel.

17 Claims, 3 Drawing Figures

BLANK FOR CARTON FOR HOLDING AND DISPENSING PLASTIC FILM

This invention relates in general to new and useful improvements in cartons, and more particularly to a carton for dispensing plastic film.

There has been developed in the past cartons for dispensing plastic film wherein the carton has a base area including a front wall panel and wherein there is a cover having a front panel which overlaps an upper portion of the front wall panel. Further, the front panel of the cover is provided with a cutting edge whereby the desired quantity of the packaged plastic film may be drawn between the front panel and the front wall panel and then drawn upwardly against the cutting edge to sever the dispensed portion.

In addition, cartons of the type described above have been provided with a sticky dot applied to a central upper part of the front wall panel whereby when the front panel of the cover is squeezed against the front wall panel in the severing of the portion of the plastic film to be dispensed, the plastic film will stick to the upper part of the front wall panel and remain in place for grasping and further withdrawal. However, these prior art cartons have the deficiency in that only a small amount of adhesive coating has been feasible and the adhesive coating adheres to each new portion of the plastic film with the result that the adhesive coating does not always last for the dispensing of the entire roll of plastic film. The adhesive coating also collects dust and dirt due to high tack level.

In accordance with this invention, the opposite face of the front wall panel in the carton blank stage is provided with a release coating. Thus when the carton blanks are printed and formed and thereafter stacked, the release coating prevents the adhesive coating from sticking to the next carton blank. Thus, by the proper application of a release coating on the opposite face of the front wall panel from that portion to which there is applied the adhesive coating, the carton blanks will not stick together.

The overall application of the release coating, however, presents other problems. First of all, an undesirable amount of release coating is required. Secondly, the front wall panel is provided at its upper edge with a reversely folded reinforcing flap which must be bonded to that part of the opposite face of the front wall panel to which the release coating must be applied. In order to solve both of these problems, in accordance with this invention, it is proposed to apply the release coating in a partial pattern. Thus the area on the opposite face of the front wall panel from that to which the adhesive coating is applied may have a pattern of release coating and intermediate areas of uncoated panel surface. The thickness of the release coating will be sufficient to prevent the sticking of the adhesive coating to the uncoated areas in the normal forming and stacking of the blanks while at the same time the adhesive applied to the reinforcing flap will be sufficient to flow between the uncoated areas within the release coating so as to bond to the uncoated areas and retain the reinforcing flap in its required position.

With the above and other objects in view that will hereinafter appear, the nature of the invention will be more clearly understood by reference to the following detailed description, the appended claims, and the several views illustrated in the accompanying drawings.

Figure 2:
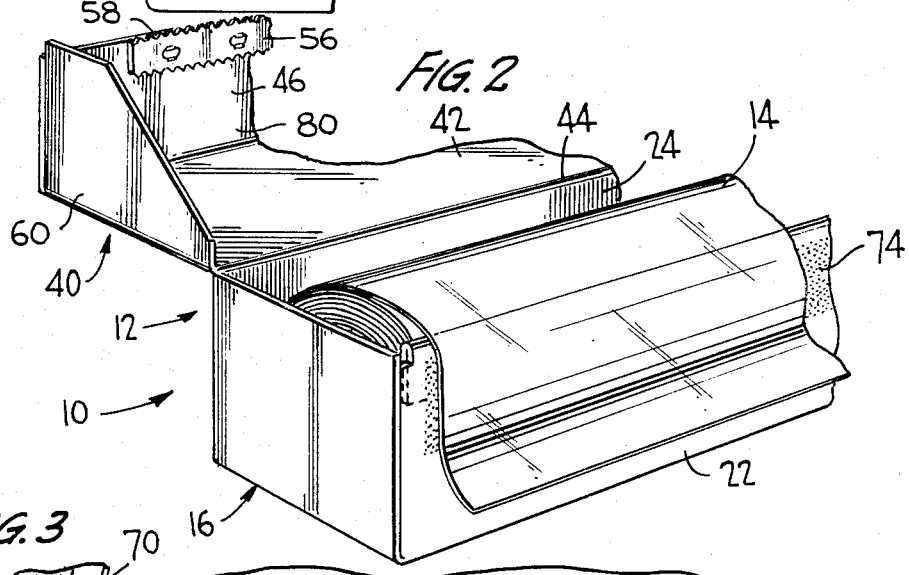
FIG. 2 is a perspective view of one end of a carton formed from the blank of FIG. 1 and shows disposed therein a roll of plastic film which is to be dispensed, the carton cover being in its opened position.

Referring now to the drawings in detail, it will be seen that there is illustrated in FIG. 2 a portion of a plastic film package generally identified by the numeral 10. The plastic film package 10 includes a carton 12 in which a roll 14 of plastic film is placed ready for dispensing in increments.

The carton 12 includes a base portion 16 having a bottom wall panel which has connected to a front edge thereof along a fold line 20 a front wall panel 22. The bottom panel 18 also has connected thereto a rear wall panel 24 along a fold line 26.

Figure 1:
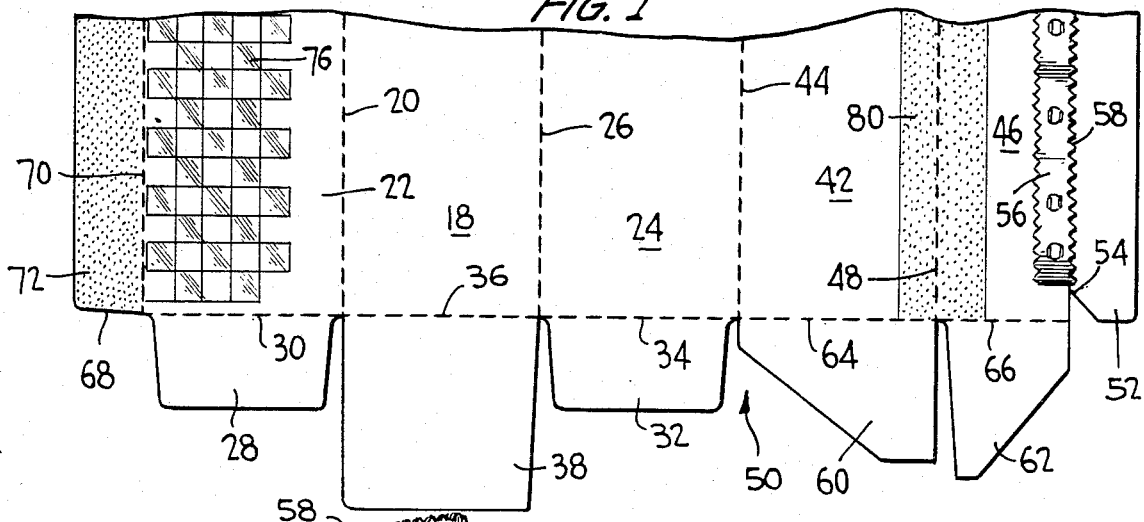
FIG. 1 is a plan view of the inner surface of one end of a blank for a carton formed in accordance with this invention.

As is best shown in FIG. 1, the front wall panel 22 has at each end thereof an end flap 28 connected thereto along a fold line 30. A similar end flap 32 is carried by each end of the rear wall panel 24 along a fold line 34. The bottom panel 18 has connected to each end thereof along a fold line 36 an end panel 38. It is to be understood that the end flaps 28 and 32 are adhesively secured to the inner surface of the end panel 38 at each end of the carton 12 to form the rigid base 16 which is open at the top.

The carton 12 also includes a cover 40 which is integrally formed with the base 16. The carton 40 includes a top wall panel 42 which is connected to the rear wall panel 24 along a fold line 44. There is also a panel 46 which defines a front panel of the cover 40. The cover 46 is connected to the panel 42 along a fold line 48.

The carton blank of FIG. 1, which blank is identified by the numeral 50 also includes a tear off strip 52 which is connected to the front panel 46 along a weakening line 54.

It is also to be noted that there is suitably secured to the end surface of the front panel 46 a cutter 56 which has an exposed cutting edge 58 in the opened carton which extends across the line 54.

The top wall panel 42 and the front panel 46 are connected together by suitable flaps 60, 62 carried by these panels with the flap 60 being connected to the panel 42 along a fold line 64 and the flap 62 being connected to the panel 46 along a fold line 66. The flaps 60, 62 are adhesively bonded together.

Finally, the front wall panel 22 carries a reinforcing flap 68 which is connected thereto along a fold line 70. The reinforcing flap 68 is provided on the inner surface thereof with an adhesive coating 72 for bonding to the inner face of the front wall panel 22 when the flap 68 is reversely folded.

It is also to be understood that the tear off strip 52 will have a certain amount of adhesive to lightly connect the same to a lower part of the front wall panel 22 to form a sealed carton.

In the past, a central upper part of the front wall panel 22 has been provided with an adhesive dot formed of an adhesive which will lightly stick to the projecting part of the plastic film to maintain the plastic film in place both during the cutting off of a dispensed portion and during the normal storage of the partial roll 14. However, in the past that adhesive spot has not always contained sufficient adhesive to last for the full extent of the roll. Thus after a dispensing of a portion only of the roll 14, the adhesive spot can wear out. Due to the high tack level, the adhesive spot also can become dusty and dirty thus reducing tack level.

At first glance, one would believe that the simple solution is to provide for a greater extent of adhesive coating. However, this has not proved as simple as one would suspect. On the other hand, in accordance with this invention, the upper part of the front wall panel 22 on the outer face thereof including the outside face of flap 68 and fold line 70 is provided with a printed registered continuous film strip 74 of adhesive coating. The extent of the stripe 74 of adhesive coating is more than sufficient to, upon each dispensing of a small portion of the roll 14, stick to the projecting part of the roll to hold the remaining part of the roll 14 in place.

The overall application of the adhesive stripe 74 presented the problem that when the carton blanks 50 are formed, they are normally stacked and the adhesive of the adhesive stripe 74 would stick to the next underlying carton blank. Applicant has solved this by applying to the opposite or inner face of the upper part of the front wall panel 22 a release coating 76 which is generally aligned with the adhesive coating so as to prevent sticking. This release coating 76, however , presented a different problem in that in the erecting of the carton 12 the reinforcing flap 68 must be reversely folded against the inner surface of the front wall panel 22 and bonded thereto in that area carrying the release coating 76.

In accordance with this invention, all problems have been solved together with an advantage of a reduction of the amount of release coating required, by applying the release coating 76 in a pattern which includes areas of release coating and areas of no coating. The preferred pattern is a checkerboard pattern as is shown in the drawings. However, other patterns will suffice.

It is to be understood that the release coating 76 will be applied in sufficient thickness so as to prevent the adhesive stripe 74 to adhere to the uncoated areas lying within the release coating. At the same time, the adhesive coating 72 will be sufficient to provide the effective bond between the rear or inner surface of the front wall panel 22 and the reinforcing flap 68.

A leading portion of the plastic film of the roll 14 will be manually engaged and pulled out from between the front panel 46 and the front wall panel 22 and while the front panel 46 is squeezed back towards the front wall panel 22, thereby sticking a new area of the plastic film to the adhesive stripe 74, the extended portion of the roll of plastic film may be torn off by pulling up against the cutting edge 58.

Figure 3:
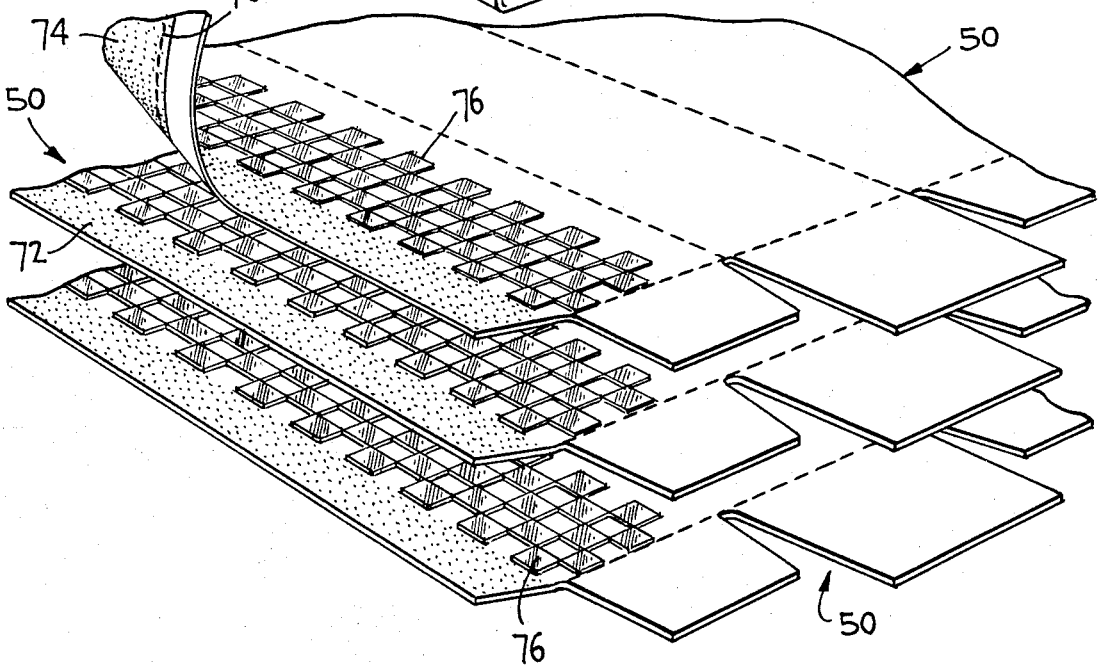
FIG. 3 is a fragmentary perspective view of newly formed carton blanks such as that of FIG. 1 and shows the same in spaced relation ready to be stacked.

Although the preferred embodiment of the invention has been described, consideration should also be given to widening the adhesive stripe to extend across the fold line 70 onto the reinforcing flap 68 (FIG. 3). In this manner, when the plastic film of the roll 14 is pulled down to sever the same, the plastic film will stick to the top edge of the front panel 22.

It may also be desirable to a print release coating 80 on the inner face of the front panel 46 and part of the top wall panel 42 to insure that the adhesive stripe 74 will not stick during package transit prior to consumer use. The release coating 80 will not require the checker board configuration.

Although only a preferred embodiment of the carton and the application of a release coating has been specifically illustrated and described herein, it is to be understood that minor variations may be made in the carton construction without departing from the spirit and scope of the invention as defined by the appended claims.

I claim:

1. In a carton blank for a plastic film, a panel positioned for engagement of an outer face portion thereof by a leading edge of the plastic film, said panel outer face portion having thereon an adhesive coating to which the plastic film will stick, and a release coating on an opposite face of said panel substantially in alignment with said adhesive coating whereby newly coated and stacked blanks will not adhere to one another.

2. A carton blank in accordance with claim 1 wherein said release coating is applied in a partial application pattern to minimize the amount of release coating required.

3. A carton blank in accordance with claim 1 wherein said adhesive coating is printed, registered, continuous film coating, and said release coating is applied in a partial application pattern to minimize the amount of release coating required.

4. A carton blank in accordance with claim 3 wherein said partial application pattern is a checkerboard pattern.

5. A carton blank in accordane with claim 2 wherein said partial application pattern is a checkerboard pattern.

6. A carton blank in accordance with claim 3 wherein said adhesive coating extends substantially the full length of said panel.

7. A carton blank in accordance with claim 1 wherein said panel is a front wall panel, said carton is of the type including a cover having a front panel which overlaps an upper part only of said front wall panel and has a cutting edge along a free edge thereof, and said adhesive coating is applied substantially solely to that part of said front wall panel overlapped by said cover front panel.

8. A carton blank in accordance with claim 7 wherein said adhesive coating is a continuous film coating, and said release coating is applied in a partial application pattern to minimize the amount of release coating required and allow gluing of reinforcing flap.

9. A carton blank in accordance with claim 8 wherein said partial application pattern is a checkerboard pattern.

10. A carton blank in accordance with claim 8 wherein said adhesive coating extends substantially the full length of said panel.

11. A carton blank in accordance with claim 1 wherein said panel has connected thereto a terminal reinforcing flap for reverse folding over a part of said panel opposite face for securement to that part of said opposite face having said release coating thereon, and said release coating being applied in a partial application pattern wherein there is generally within the confines of said release coating pattern uncoated areas of said opposite face to which said reinforcing flap may be bonded.

12. A carton blank in accordance with claim 11 wherein said partial application pattern is a checkerboard pattern.

13. A carton blank according to claim 11 wherein said partial application pattern also saves release coating.

14. A carton blank according to claim 7 wherein said adhesive coating is applied to a top portion of said first-mentioned panel and over at least a top edge thereof.

15. A carton blank according to claim 11 wherein said adhesive coating is applied to a top portion of said first-mentioned panel and over at least a top edge thereof and partially on said reinforcing panel.

16. A carton blank according to claim 14 wherein release coating is also applied to an inner surface of said cover front panel.

17. A carton blank according to claim 16 wherein said cover includes a top panel, and said release coating is also applied to an under surface of said top panel adjacent to the release coating applied to said cover front panel.

* * * * *